US006341641B1

(12) United States Patent
Lin

(10) Patent No.: US 6,341,641 B1
(45) Date of Patent: Jan. 29, 2002

(54) MOLD WITH ADDITIONAL THERMO CHAMBER FOR HOMOGENEOUS TEMPERATURE DISTRIBUTION

(76) Inventor: Liken Lin, No. 35, Sec. 4, Chung Yang Rd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 09/698,285

(22) Filed: Oct. 30, 2000

(51) Int. Cl.[7] ..... B22D 17/08
(52) U.S. Cl. ..... 164/312; 164/113
(58) Field of Search ..... 164/312, 338.1, 164/355, 359, 418, 113

(56) References Cited

U.S. PATENT DOCUMENTS 4,270,594 A * 6/1981 Chumakov ..... 164/338.1

* cited by examiner

*Primary Examiner*—Nam Nguyen
*Assistant Examiner*—I.-H. Lin
(74) *Attorney, Agent, or Firm*—Jacobson Holman, PLLC

(57) ABSTRACT

A mold with additional thermo chamber for homogenous temperature distribution comprises a first mold half having a first mold cavity and a plurality of first distributing channels directing to the first mold cavity. The first mold half further includes a sprout in communicating with the first distributing channels. A second mold half has a second mold cavity corresponding to the first mold cavity. The second mold half further includes a recess for receiving the sprout of the first mold half. The second mold further includes an inlet in communicating with the sprout for receiving molten metal. A third mold half is assembled to the first mold half. A thermo chamber is defined between the third mold half and the first mold half for receiving molten metal therein thereby increasing mold temperature of the first mold.

1 Claim, 7 Drawing Sheets

MOLD WITH ADDITIONAL THERMO CHAMBER FOR HOMOGENEOUS TEMPERATURE DISTRIBUTION

BACKGROUND OF THE INVENTION

1. Field of the Invention

The present invention relates to a metal mold, and more particularly to a metal mold with additional thermo chamber sprout for providing homogeneous and high temperature distribution over the mold thereby benefiting robust molding process of compact workpiece.

2. Description of the Prior Art

Conventionally, magnesium and aluminum are ideal metal for injection molding because their melting temperatures are lower than steel which is usually used for mold. In addition, both magnesium and aluminum have very good flow capacity, accordingly, it can be used for molding compact workpiece, such as an enclosure of notebook computer.

Referring to FIG. 8, a typical mold includes a male mold half (a), and a female mold half (b) and each is formed with a cavity (a1, b1), a plurality of distributing channels (a2, b2), and a sprout (c) in communication with the distributing channels (a2). The male mold half (a) is equipped with a plurality of heating tubes (d), as shown in FIGS. 9 and 10. The female mold half (b) further includes a recess (b3) in adjacent to the distributing channels (b2) for receiving the sprout (c) of the male mold half (a). The female mold half (b) further includes an inlet (b4) which receives molten metal through a nozzle (e1) of an ejector (e), thereby filling the cavities (a1, b1), as clearly shown in FIGS. 11 and 12.

Since the male and female mold halves (a, b) are used to form the compact workpiece, such as the notebook enclosure, the cavities (a1, b1) have a very thin thickness. In order to ensure the molten metal can completely fill the cavities (a1, b1) before it is consolidated resulted from temperature differential, the male mold half (a) should constantly heated by the heating tube (d).

In general, during the injection molding process of the molten metal, such as the Mg—Al alloy, the temperature of the male and female mold halves (a, b) should be kept around 350–370 degrees Celsius. However, as the heat loss of the heating tube (d) through its length, the temperature of the male mold half (a) can only be heated around 170 to 180 degrees Celsius. As a result, the filling of the molten metal within the cavities (a1, b1) will be heavily impaired. For example, the molten metal starts to consolidate right after it reaches to the cavities (a1, b1). It is unlikely that the molten metal can completely fill the cavities (a1, b1), especially to the detailed portions of the cavities (b1, a1). Consequently, the defective workpiece are increased and which results increasing of the cost.

SUMMARY OF THE INVENTION

It is a primary object of the present invention to provide a metal mold with additional thermo chamber sprout for providing homogeneous and high temperature distribution over the mold thereby benefiting robust molding process of compact workpiece.

A further object of the present invention is to provide a metal mold with a bottom mold half arranged between a male mold half and a holder of an injecting machine. Therefore, the holder 6 is prevented from being overheated by the male mold half.

In order to achieve the objective set forth, a mold with additional thermo chamber for homogenous temperature distribution in accordance with the present invention comprises a first mold half having a first mold cavity and a plurality of first distributing channels directing to the first mold cavity. The first mold half further includes a sprout in communicating with the first distributing channels. A second mold half has a second mold cavity corresponding to the first mold cavity. The second mold half further includes a recess for receiving the sprout of the first mold half. The second mold further includes an inlet in communicating with the sprout for receiving molten metal. A third mold half is assembled to the first mold half. A thermo chamber is defined between the third mold half and the first mold half for receiving molten metal therein thereby increasing mold temperature of the first mold.

BRIEF DESCRIPTION OF THE DRAWINGS

Other objects and advantages of the present invention will become apparent from the following detailed description of the preferred embodiments thereof taken in conjunction with the accompanying drawings wherein.

DETAILED DESCRIPTION OF PREFERRED EMBODIMENT

Figure 1:
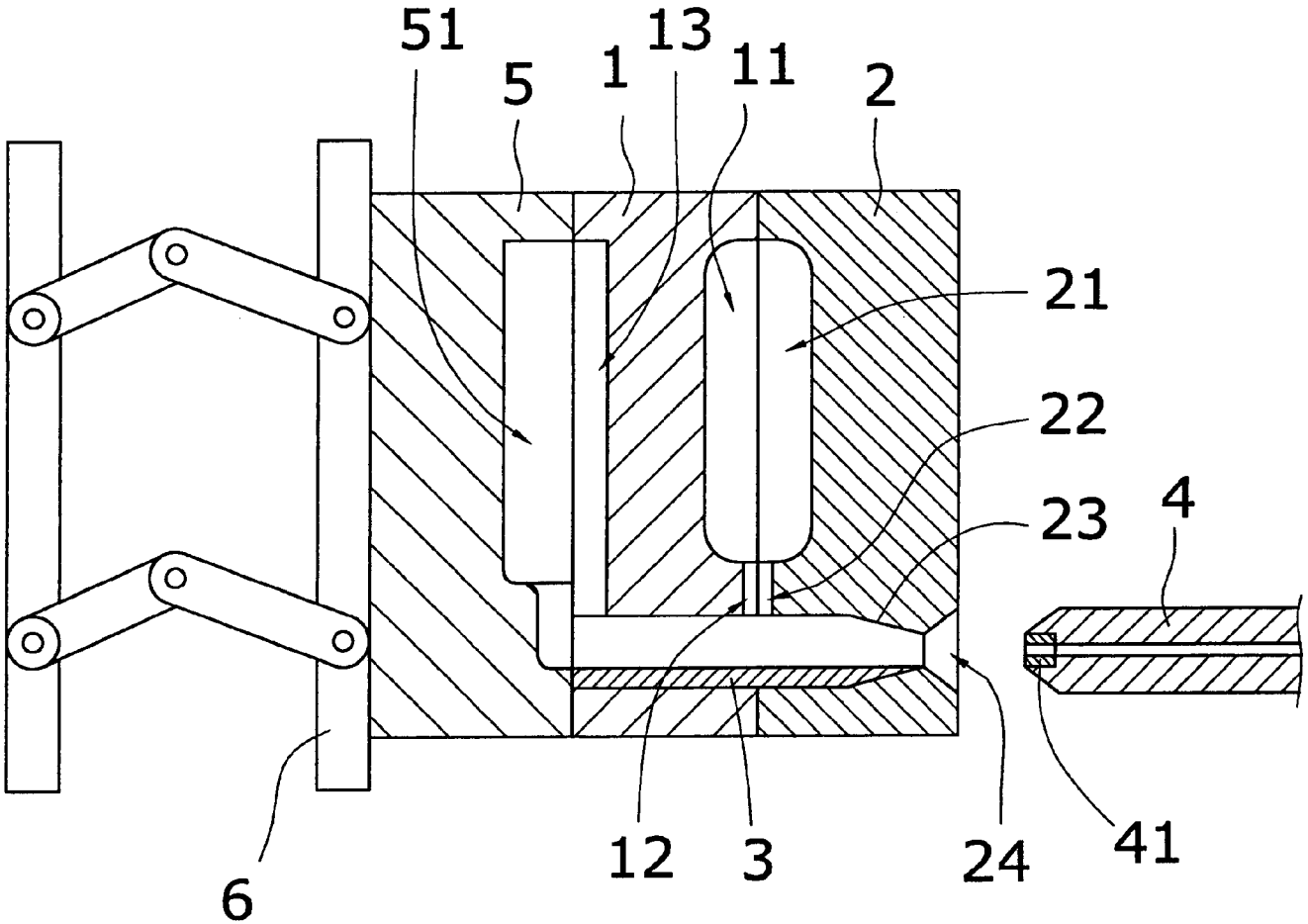
FIG. 1 is a cross sectional view of an assembled mold in accordance with the present invention.
Figure 3:
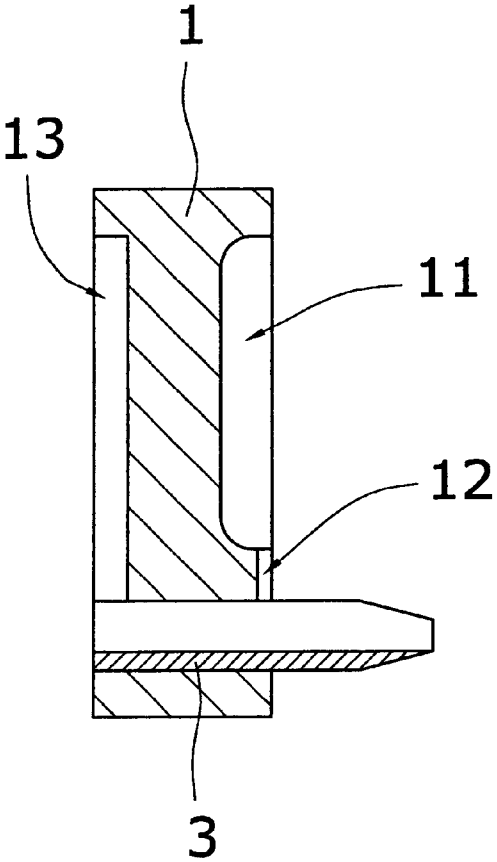
FIG. 3 is a cross sectional view of FIG. 2.
Figure 2:
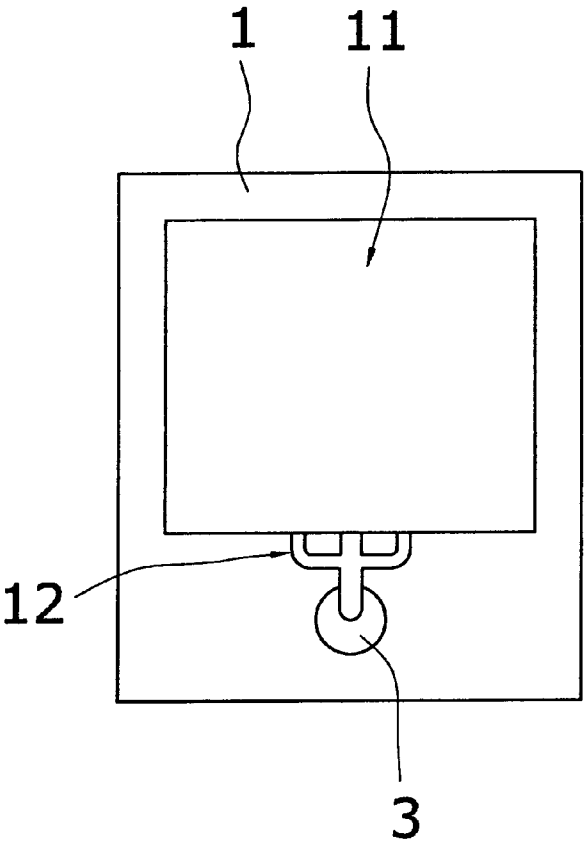
FIG. 2 is a top plan view of a male mold half in accordance with the present invention.

Referring to FIGS. 1 to 8, a mold with additional thermo chamber for homogenous temperature distribution in accordance with the present invention comprises a male mold half 1 having a first mold cavity 11 and a plurality of first distributing channels 12 directing to the first mold cavity 11. The male mold half 1 further includes a sprout 3 in communicating with the first distributing channels 12, as shown in FIGS. 2 & 3.

Figure 5:
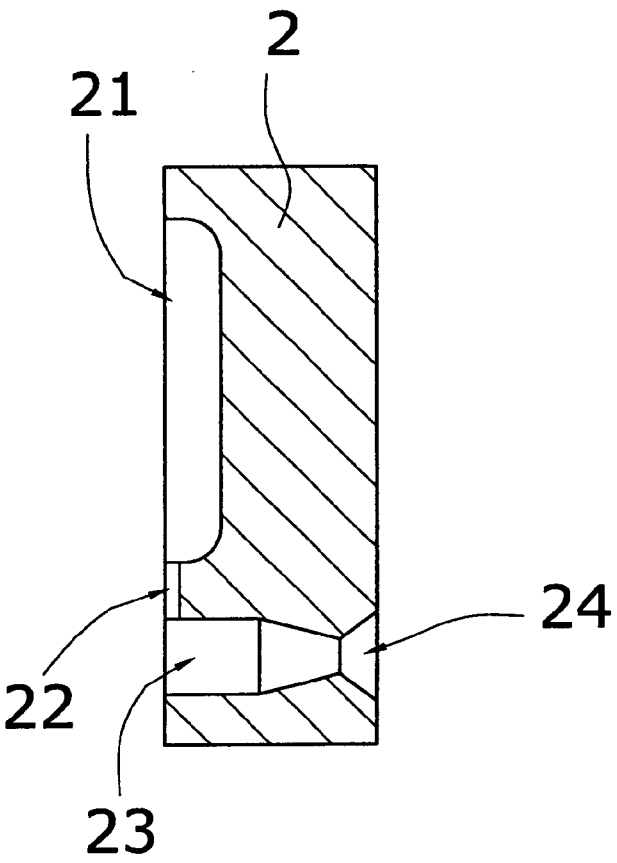
FIG. 5 is a cross sectional view of FIG. 4.
Figure 4:
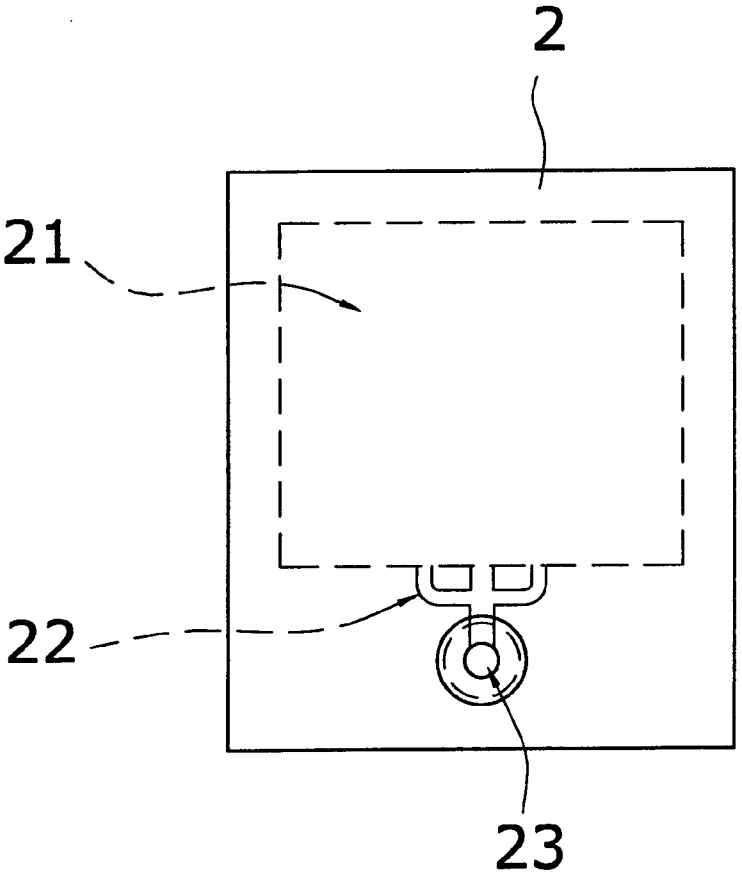
FIG. 4 is a top plan view of a female mold half in accordance with the present invention.

A female mold half 2 has a second mold cavity 21 corresponding to the first mold cavity 11. The female mold half 2 further includes a plurality of distributing channels 22 corresponding to the first distributing channels 12. The female mold half 2 includes a recess 23 for receiving the sprout 3 of the male mold half 1. The female mold half 2 further includes an inlet 24 in communicating with the sprout 3 and recess 24 for receiving molten metal, as shown in FIGS. 4 & 5. An ejector 4 with a nozzle 41 which is mateable with said inlet 24 for injecting molten metal into the mold cavities 11, 21.

Figure 7:
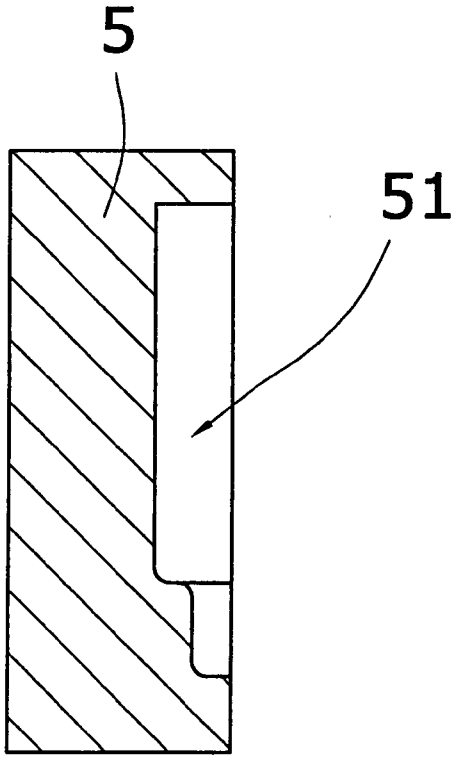
FIG. 7 is a cross sectional view of FIG. 6.
Figure 6:
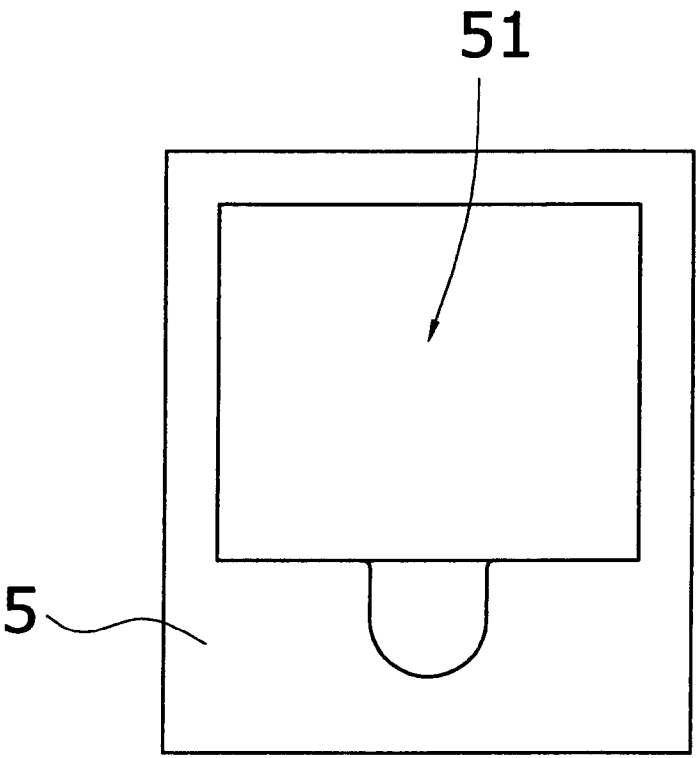
FIG. 6 is a top plan view of a bottom mold half in accordance with the present invention.
Figure 8:
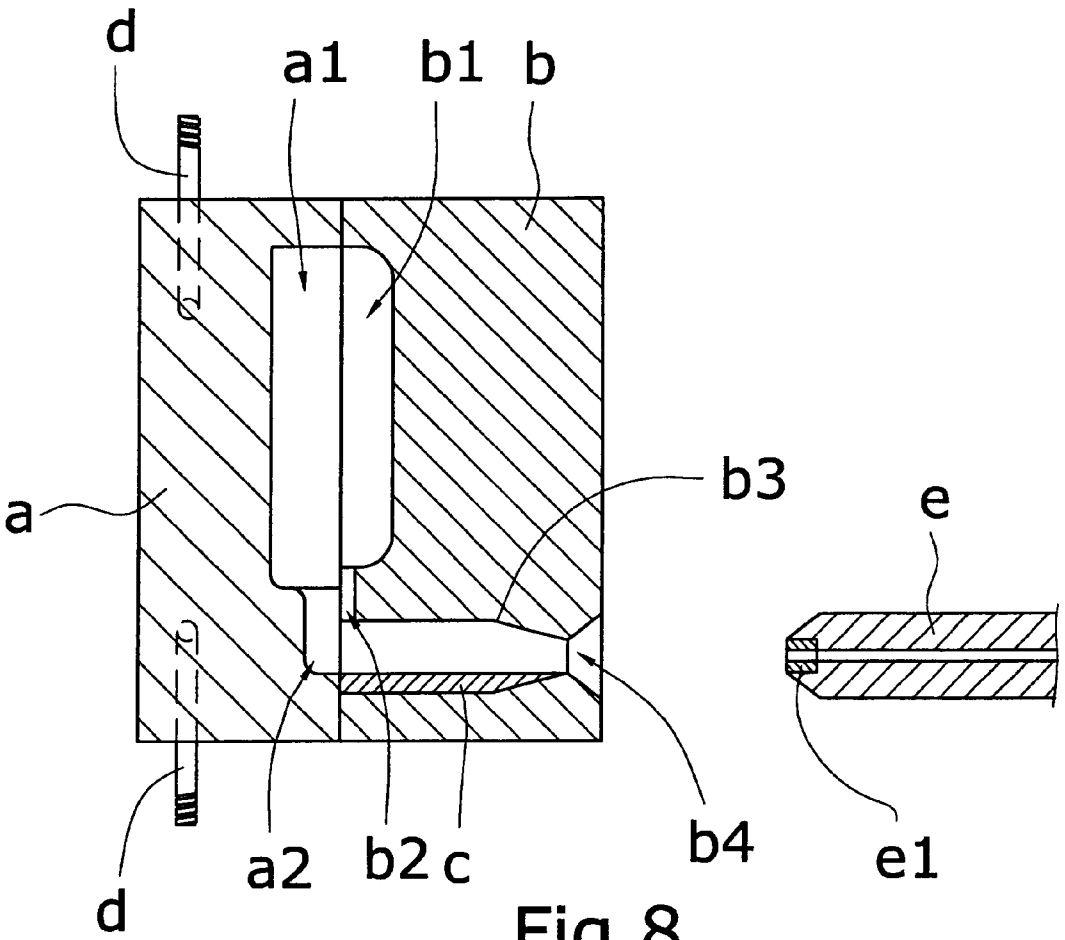
Fig.8 (PRIOR ART)
FIG. 8 is an assembled view of prior art mold.
Figure 10:
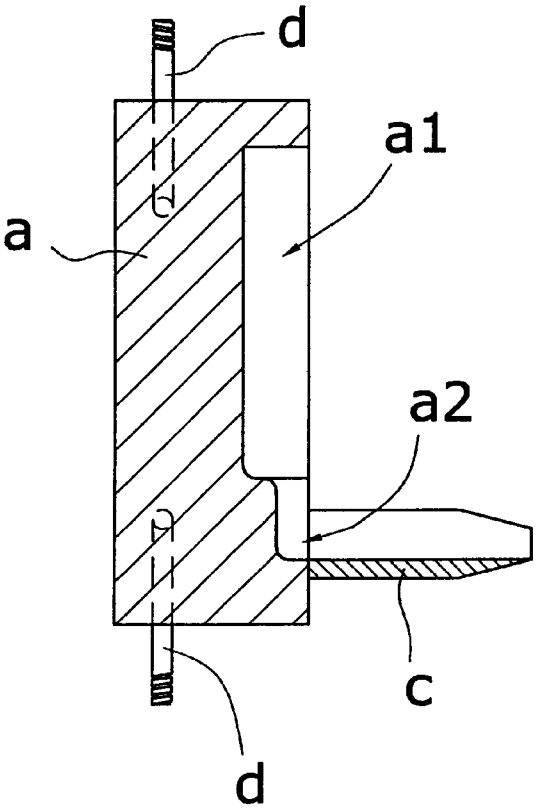
Fig.10 (PRIOR ART)
FIG. 10 is a cross sectional view of FIG. 9.
Figure 9:
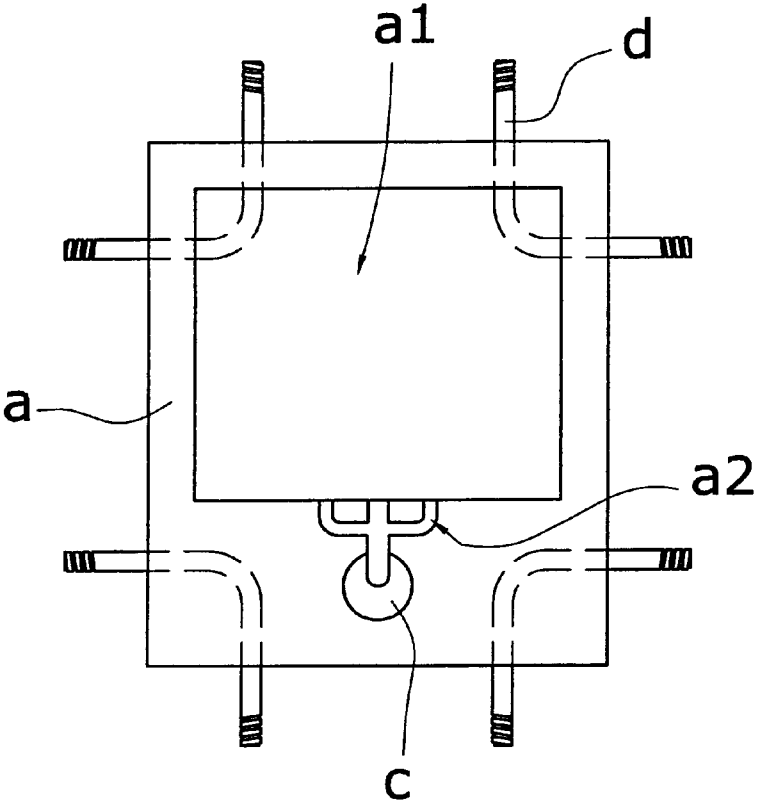
Fig.9 (PRIOR ART)
FIG. 9 is a top plan view of a prior art male mold.
Figure 12:
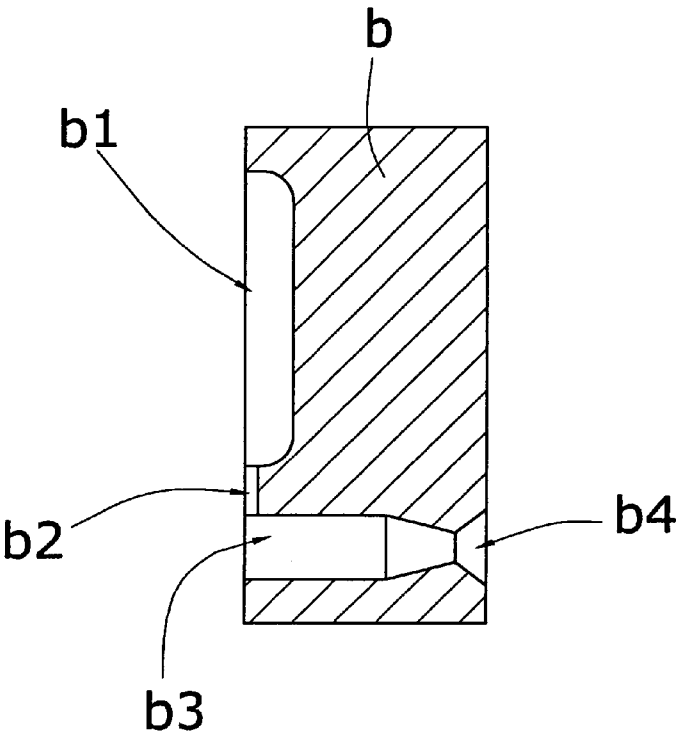
Fig.12 (PRIOR ART)
FIG. 12 is a cross sectional view of FIG. 11.
Figure 11:
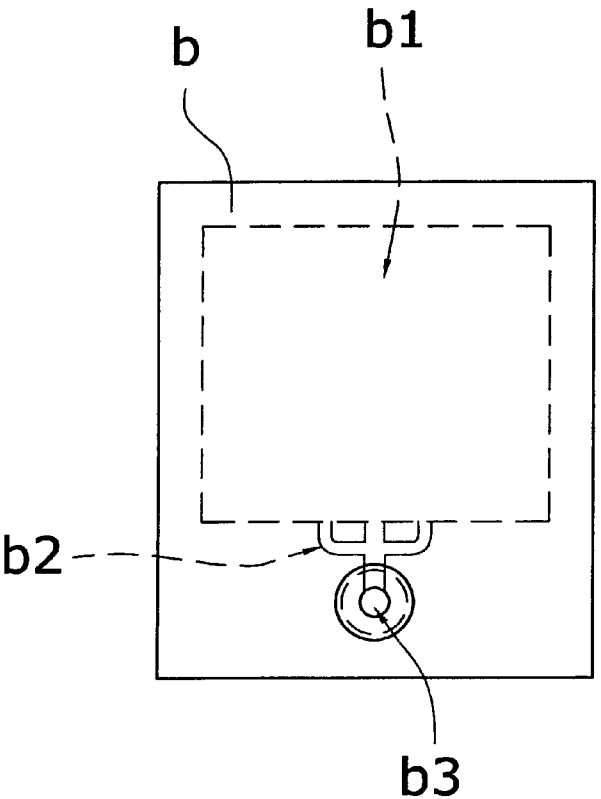
Fig.11 (PRIOR ART)
FIG. 11 is a top plan view of a prior art female mold.

A bottom mold half 5 is assembled to the male mold half 1, referring to FIGS. 6 & 7. Thermo chambers 13, 51 are defined between the bottom mold half 5 and the male mold half 1. Both the thermo chambers 13, 51 are communicated with the sprout 3. As a result, when the molten metal is received therein through the sprout 3, a mold temperature of the male mold 1 can be increased by the molten metal.

When the ejector 4 is inserted into the inlet 24 with the nozzle 41, the molten metal is injected into the sprout 3, then to the mold cavities 11, 21. In addition, since the spout 3 is in communicating with the thermo chambers 13, 51, the molten metal is further injected thereto. As a result, the male mold half 1 can be further heated by the molten metal. According to the experience, the mold temperature of the male mold half 1 may reach 650 to 680 degrees Celsius thereby facilitating homogenous distribution of the molten metal over the mold cavities 11, 21. By this arrangement, the defect rate of the workpiece can be therefore reduced.

In addition, since the bottom mold half 5 is arranged between the male mold half 1 and a holder 6 of an injecting machine, the holder 6 is prevented from being overheated by the male mold half 1.

While specific illustrated embodiment has been shown and described, it will be appreciated by those skilled in the-art that various modifications, changes, and additions can be made to the invention without departing from the spirit and scope thereof as set forth in the following claims.

What is claimed is:

1. A mold with additional thermo chamber for homogenous temperature distribution comprising:

a male mold half having a first mold cavity and a plurality of first distributing channels directing to said first mold cavity, said male mold half further including a sprout in communicating with said first distributing channels;

a female mold half having a second mold cavity corresponding to said first mold cavity and a plurality of second distributing channels in communicating with said spout of said male mold half, said female mold half further including a recess for receiving said sprout of said male mold half, said female mold further including an inlet in communicating with said sprout for receiving molten metal;

and the improvement of the device is characterized in a bottom mold half assembled to said male mold half, a thermo chamber defined between said bottom mold half and said male mold half for receiving molten metal therein thereby increasing mold temperature of said male mold, wherein said bottom mold is arranged between a holder of an injecting machine and said male mold half thereby preventing overheating of the holder of the injecting machine.

* * * * *